US007036948B1

(12) United States Patent
Wyatt

(10) Patent No.: US 7,036,948 B1
(45) Date of Patent: May 2, 2006

(54) ILLUMINATED ELECTRICAL OUTLET AND LIGHT SWITCH

(76) Inventor: Bryan Wyatt, 810 Par St., Douglas, GA (US) 31533

( * ) Notice: Subject to any disclaimer, the term of this patent is extended or adjusted under 35 U.S.C. 154(b) by 0 days.

(21) Appl. No.: 10/638,794

(22) Filed: Aug. 11, 2003

(51) Int. Cl.
*F21V 1/10* (2006.01)
*H01R 3/00* (2006.01)

(52) U.S. Cl. ..... 362/95; 439/490; 362/276; 362/360

(58) Field of Classification Search ..... 362/95, 362/276, 360, 282, 802, 20; 324/76.11; 340/660, 340/664; 702/64; 439/490
See application file for complete search history.

(56) References Cited

U.S. PATENT DOCUMENTS

| | | | | | |
|---|---|---|---|---|---|
| 1,720,463 | A | | 7/1929 | Both | |
| 2,015,698 | A | | 10/1935 | Tiffany | |
| 2,863,038 | A | * | 12/1958 | Lombardo | 362/20 |
| 3,265,888 | A | | 8/1966 | Adolphson, Jr. | |
| 3,307,030 | A | | 2/1967 | De Francisco | |
| 3,739,226 | A | * | 6/1973 | Seiter et al. | 315/86 |
| 3,895,225 | A | | 7/1975 | Prior | |
| 4,667,073 | A | | 5/1987 | Osika | |
| 4,774,641 | A | | 9/1988 | Rice | |
| 5,112,237 | A | * | 5/1992 | Yang | 439/188 |
| 5,277,620 | A | * | 1/1994 | Taylor | 439/490 |
| 5,544,025 | A | * | 8/1996 | Bohlool et al. | 362/95 |
| 5,683,166 | A | | 11/1997 | Lutzker | |
| 5,811,730 | A | | 9/1998 | Rintz | |
| 5,816,682 | A | * | 10/1998 | Marischen | 362/84 |
| 6,051,787 | A | | 4/2000 | Rintz | |
| 6,089,893 | A | | 7/2000 | Yu et al. | |
| 6,109,760 | A | | 8/2000 | Salatrik et al. | |
| 6,827,602 | B1 | * | 12/2004 | Greene et al. | 439/490 |
| 6,891,478 | B1 | * | 5/2005 | Gardner | 340/635 |
| 2002/0131262 | A1 | * | 9/2002 | Amburgey | 362/95 |
| 2003/0092297 | A1 | * | 5/2003 | Reindle et al. | 439/107 |

* cited by examiner

*Primary Examiner*—Sandra O'Shea
*Assistant Examiner*—Anabel Ton
(74) *Attorney, Agent, or Firm*—Michael I. Kroll

(57) ABSTRACT

A light switch and/or a socket which is illuminatable to aid a user in detecting its position in a dimly lit room. The light switch includes a housing and a lighting element positioned within the housing. A detector detects a level of illumination surrounding the light switch. Based upon this detection the lighting element is illuminated upon determining the detected level of illumination is below a predetermined value thereby aiding in locating said light switch in a dimly lit room. The electrical outlet includes a receptacle having a face plate and at least one lighting element positioned around the periphery of the face plate. A detector detects a level of illumination surrounding the electrical outlet. The at least one lighting element is illuminated upon determining the detected level of illumination is below a predetermined value thereby aiding in locating said electrical outlet in a room illuminated below a predetermined level. A second lighting element may be positioned around a periphery of the first lighting element. A load sensor is provided for sensing the voltage of a load drawn from an input voltage and a comparator compares the sensed load value with a threshold value for determining the capacity of a circuit. When the detected said load value is less than a threshold value, the first lighting element is illuminated and, when the detected load value is greater than the threshold value, the second lighting element is illuminated.

5 Claims, 11 Drawing Sheets

ILLUMINATED ELECTRICAL OUTLET AND LIGHT SWITCH

BACKGROUND OF THE INVENTION

1. Field of the Invention

The present invention relates generally to electrical outlets and, more specifically, to illuminated electrical outlets and switches. The outlets and switches are illuminated by electro-illuminescent strips deriving power from the input voltage. The outlets and switches contain a brightness sensor which senses the amount of light present in a room and, upon a determination that the light is below a reference level, the electro-illuminescent strips are caused to be illuminated. Also, the outlets may include at least two luminous strips each having a different color for indicating the status of that particular socket.

2. Description of the Prior Art

Numerous other illuminating devices designed for electrical outlets and light switches are present in the prior art. Typical of these is U.S. Pat. No. 1,720,463 issued to Both on Jul. 9, 1929. A patent was issued to Tiffany on Oct. 1, 1935 as U.S. Pat. No. 2,015,698. Yet another U.S. Pat. No. 3,265,888 was issued to Adolphson, Jr. on Aug. 9, 1966 and De Francisco was issued U.S. Pat. No. 3,307,030 on Feb. 28, 1967. Prior was issued U.S. Pat. No. 3,895,225 on Jul. 15, 1975 and on May 19, 1987 Osika was issued U.S. Pat. No. 4,667,073.

Rice was issued U.S. Pat. No. 4,774,641 on Sep. 27, 1988 and U.S. Pat. No. 5,683,166 was issued to Lutzker on Nov. 4, 1997. U.S. Pat. No. 5,811,730 was issued to Rintz on Sep. 22, 1998. U.S. Pat. No. 6,051,787 was issued to Rintz on Apr. 18, 2000. Yu et al. was issued U.S. Pat. No. 6,089,893. Salatrik was issued U.S. Pat. No. 6,109,760 on Aug. 29, 2000.

While these illuminated receptacles may be suitable for the purposes for which they were designed, they would not be as suitable for the purposes of the present invention, as hereinafter described.

U.S. Pat. No. 1,720,463

Inventor: Tonjes A. Both

Issued: Jul. 9, 1929

In a device of the character described, a receptacle having contacts to engage the blade contacts of an attachment plug cap, means for connecting said receptacle contacts to the leads from a source of current, a pilot lamp mounting having contacts to engage those of a pilot lamp, a connection from one of the pilot lamp contacts to one of the receptacle contacts, and an auxiliary contact connected to the other lamp contact and positioned adjacent the other receptacle contact but spaced therefrom in position to engage a cap contact and extending outwardly beyond said receptacle contact so that it will be engaged by the cap contact before said cap contact engages the receptacle contact as the cap is plugged into the receptacle.

U.S. Pat. No. 2,015,698

Inventor: Frank Emery Tiffany

Issued: Oct. 1, 1935

A switch-plate of the character described, having an outwardly extending housing provided with a sight window and said plate having a plurality of openings through which fastening devices and a switch operating member may extend, the front and end walls of the housing being formed integral with the plate and located within the marginal edges thereof, and a gaseous light bulb supported within said housing in rear of its window, said bulb having its electrodes terminating in flexible lead wires adapted to be readily attached to the terminals of an electric switch circuit located in rear of the said plate to provide a shunt circuit in which said gas bulb is included, the construction and arrangement being such that no part of the bulb or it lead wires projects beyond the upper edge of the plate.

U.S. Pat. No. 3,265,888

Inventor: Carl Bradford Adolphson, Jr.

Issued: Aug. 9, 1966

An electrical duplex outlet which comprises: a two part body of insulating material having a front surface and defining therein a first and a second receptacle, each including first and second cavities, said front surface defining first and second parallel slots in each receptacle communicating, respectively, with said first and second cavities, said body further including a wall portion extending between the first and second cavities of each receptacle, said wall defining first and second substantially cylindrical wells positioned, respectively, between each pair of first and second cavities and extending substantially perpendicular to said front surface but with its forward end being spaced therefrom, the opposite side of each well piercing said wall to define rectangular parallel slots communicating, respectively, with said first and second cavities; first electrical conductor means mounted in said body and including female contacts in each of said first cavities to be contacted by a connector blade inserted through a corresponding first slot; second electrical conductor means mounted in said body and including female contacts in each of said second cavities to be contacted by a connector blade inserted through a corresponding second slot; a first substantially cylindrical electrical lamp positioned within said first well with a substantial portion of the side wall of said first lamp intermediate its ends being in contact with, and supported by, the sides of said first well, the remaining portions of the side wall of said first lamp being positioned adjacent the corresponding parallel slots to illuminate said first and second cavities therethrough, said first lamp being connected across said first and second electrical conductor means to be energized, therefrom; and a second substantially cylindrical lamp positioned within said second well with a substantial portion of the side wall of said second lamp intermediate its ends being in contact with, and supported by, the sides of said second well, the remaining portions of the side wall of said second lamp being positioned adjacent the corresponding parallel slots to illuminate said first and second cavities therethrough, said second lamp being connected across said first and second electrical conductor means to be energized therefrom.

U.S. Pat. No. 3,307,030

Inventor: Arthur De Francisco

Issued: Feb. 28, 1967

An electroluminescent device in the form of a cover plate for an electric wall fixture comprising metallic electrode plates and a layer of electroluminescent material, and a pair of electrical plug-in prongs electrically connected to two of said electrode plates and extending at right angles to said electrode plates for plug-in engagement with a source of potential to illuminate the plate, said cover plate having an aperture extending therethrough parallel to said plug-in prongs and being arranged to receive a portion of the wall fixture when said prongs are plugged into the wall fixture.

U.S. Pat. No. 3,895,225

Inventor: James C. Prior

Issued: Jul. 15, 1975

In an illuminated electrical receptacle device, the combination including a nonconductive body means 1 having electrical receptor means, a nonconductive cover-means having apertures corresponding to said receptor means and through which connector blade means can be removably inserted, said cover means having an open area for receiving lens means, grounding strap means insertable between said body means and cover means, said grounding strap means having apertures corresponding to the apertures in said cover means and said open area, illuminating means locatable under said cover means, and lens means insertable in said open area of said cover means, said lens means having gripping means for engaging said cover means and grounding strap means for removably holding said cover means, grounding strap and lens means in assembled relation.

U.S. Pat. No. 4,667,073

Inventor: Thomas F. Osika

Issued: May 19, 1987

An electrical toggle switch with self-contained indicating devices for displaying the operating condition of the switch and the electrical equipment controlled thereby. The switch may be of the single pole double throw type, or the double pole double throw type, operated by a three position toggle lever which actuates a fulcrum mounted conductive bridge. The switch housing incorporates indicating lamps with color coded lenses. A legend plate assembly mounted on the switch includes a readily interchangeable legend plate which indicates switch function whether or not specifically illuminated.

U.S. Pat. No. 4,774,641

Inventor: Keith Q. Rice

Issued: Sep. 27, 1988

An electric contact means of an illuminating device embodied into electric outlet cover plates. The electric illuminating device is connected electrically to two thin electrical conducting bifurcated blades with spring properties. The open ends of the bifurcated blades are located behind a feed slot and neutral slot in the cover plate that correspond in location to the same slots in the electric outlet. When the cover plate is installed on an electric outlet the closed ends of the two bifurcated blades are automatically inserted into the corresponding feed and neutral slots of the electric outlet making electric contact for the device embodied in the cover plate. The two thin bifurcated blades permit adequate space for normal insertion of electric appliance plugs between the bifurcated blades. Where there is more than one outlet provision, the other outlet provisions are merely corresponding openings in the cover plate that permit appliance plugs to be inserted through the cover plate into the wall outlet. The novel and new bifurcated blade electrical contact design leaves all outlets still available for electric appliance plugs, supplies electric power to the illuminating device embodied in the cover plate with or without an appliance plug installed, and is as easy to install as a standard hardware cover plate using the same attachment means.

U.S. Pat. No. 5,683,166

Inventor: Robert S. Lutzker

Issued: Nov. 4, 1997

An electroluminescent wall plate is provided with clips designed to couple with wall mounted electrical terminals.

U.S. Pat. No. 5,811,730

Inventor: William J. Rintz

Issued: Sep. 22, 1998

A light switch cover is disclosed for use with conventional "rocker" and "toggle" type switches. The cover generally includes a mounting bracket which is attached to the electrical box, along with the switch and a face plate which is attached to the mounting bracket. For "rocker" type switches, the face plate is preferably constructed from a soft material to allow the user to operate the covered "rocker" switch, but can be made of a combination of hard and soft materials. For "toggle" type switches an aperture is provided in the face plate to operate the toggle. Preferably, the outer surface of the face plate is provided with a decorated design or other indicia. The light switch can also be utilized where more than one switch is provided. For multiple "rocker" switches, a diverter bar is provided on the mounting bracket, to absorb pressure being asserted on one "rocker" switch from also transferring to an adjacent "rocker" switch and inadvertently turning "off" or "on" the adjacent "rocker" switch. An electroluminescent lighting sheet can also be provided between the face plate and mounting bracket to highlight and enhance the decorative features of the present invention light switch cover.

U.S. Pat. No. 6,051,787

Inventor: William J. Rintz

Issued: Apr. 18, 2000

A light switch cover is disclosed for use with conventional "rocker" and "toggle" type switches. The cover generally includes a mounting bracket which is attached to the electrical box, along with the switch and a face plate which is attached to the mounting bracket. For "rocker" type switches, the face plate is preferably constructed from a soft material to allow the user to operate the covered "rocker" switch, but can be made of a combination of hard and soft materials. For "toggle" type switches an aperture is provided in the face plate to operate the toggle. Preferably, the outer surface of the face plate is provided with a decorated design or other indicia. The light switch can also be utilized where more than one switch is provided. For multiple "rocker" switches, a diverter bar is provided on the mounting bracket, to absorb pressure being asserted on one "rocker" switch from also transferring to an adjacent "rocker" switch and inadvertently turning "off" or "on" the adjacent "rocker" switch. An electroluminescent lighting sheet can also be provided between the face plate and mounting bracket to highlight and enhance the decorative features of the present invention light switch cover. A battery back-up and power loss sensing circuit can be included that illuminates the lighting sheet whenever power to the light switch is lost. Upon loss of power, the lighting sheet can be illuminated steadily or can blink at a preselected frequency. An on/off switch can be provided to manually turn the illuminated light switch cover off. The invention can be utilized with pressure sensitive dome-type switches.

U.S. Pat. No. 6,089,893

Inventor: Dongxiao Yu et al.

Issued: Jul. 18, 2000

An illuminated electrical receptacle which employs a lamp containing electroluminescent material which are made to produce visible light upon the application of AC current to such materials. The lamp is flat with apertures which permit the blades of two electrical plugs to pass through from a face plate to a base containing electrical contacts. The face plate is formed of materials which permit the light produced to pass through all or selected parts of the face plate or outline the face plate or its apertures.

U.S. Pat. No. 6,109,760

Inventor: Ronald L. Salatrik et al.

Issued: Aug. 29, 2000

An illuminated power outlet assembly for a motor vehicle having an insulator and an illuminated device. The illumination device includes a light emitting diode and a resistor electrically coupled in series. The illumination device is positioned within a power outlet, specifically between the casing and the insulator, such that when the illumination device illuminates, the light passes through the insulator to light the power outlet.

SUMMARY OF THE PRESENT INVENTION

The present invention relates generally to electrical outlets and, more specifically, to illuminated electrical outlets and switches. The outlets and switches are illuminated by electro-illuminescent strips deriving power from the input voltage. The outlets and switches contain a brightness sensor which senses the amount of light present in a room and, upon a determination that the light is below a reference level, the electro-illuminescent strips are caused to be illuminated. Also, the outlets may include at least two luminous strips each having a different color for indicating the status of that particular socket.

A primary object of the present invention is to provide illuminated electrical outlets and switches that overcome the shortcomings of the prior art.

Another secondary object of the present invention is to provide illuminated electrical outlets and switches for use in low light situations for guiding a user thereto.

Another further object of the present invention is to provide illuminated electrical outlets and switches that derive their power from the receptacle source.

Still another object of the present invention is to provide illuminated outlets and switches that will indicate when power is cut off to the receptacle.

Another object of the present invention is to provide illuminated electrical outlets and switches that will indicate whether or not a particular socket is occupied.

Yet another object of the present invention is to provide illuminated outlets and switches that will indicate when a circuit is reaching its maximum load.

A further object of the present invention is to provide illuminated outlets and switches having a light sensor for detecting the level of ambient light in a room.

An even further object of the present invention is to provide illuminated outlets and switches having a comparator for comparing a level sensed by the light sensor with a reference level.

Still a further object of the present invention is to provide illuminated outlets and switches having a light source which is activated by the comparator upon detecting the light level sensed by the light sensor is below a reference level.

Yet another object of the present invention is to provide illuminated outlets and switches having two different colored light sources for notifying a user of the capacity thereof.

A further object of the present invention is to provide illuminated outlets and switches having a sensor switch for switching between the two different colored light sources when a comparator detects that a load level is at least above and below a reference level.

Yet another object of the present invention is to provide illuminated electrical outlets and switches that are simple and easy to use.

Still yet another object of the present invention is to provide illuminated electrical outlets and switches that are inexpensive to manufacture and operate.

Additional objects of the present invention will appear as the description proceeds.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
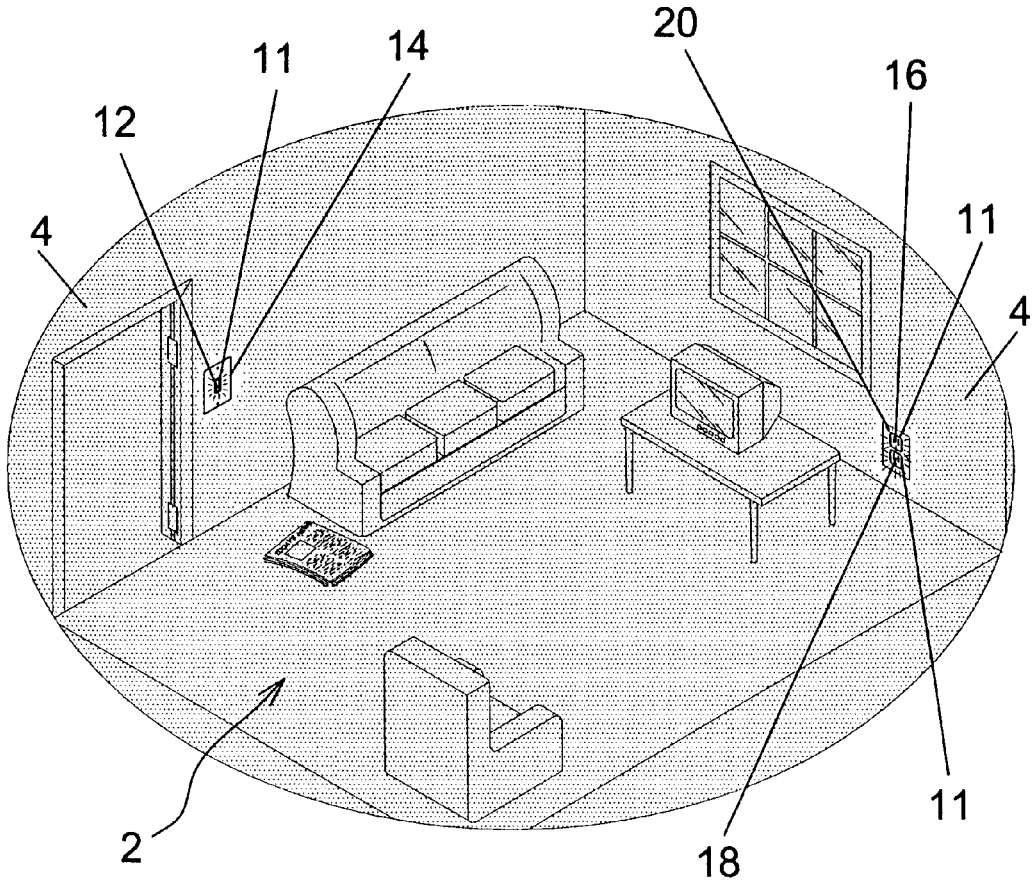
FIG. 1 is an illustrative view of the illuminated outlets and switches of the present invention in use.

Turning now descriptively to the drawings, in which similar reference characters denote similar elements throughout the several views, the Figures illustrate the illuminated outlets and switches of the present invention. With regard to the reference numerals used, the following numbering is used throughout the various drawing figures.

10 illuminated light switch/outlet of the present invention
11 light source
12 light switch
13 receptacle
14 wall plate for light switch
15 face plate of outlet
16 first outlet
18 second outlet
20 wall plate for outlet
22 first outlet opening
24 second outlet opening
26 connector
27 connector recess
28 receptacle connector
30 combination switch/outlet face plate
32 light
34 first colored light source
36 second colored light source
38 sensor switch
42 receptacle plug
44 capacity comparator
45 capacity reference
46 microprocessor
48 circuit breaker
50 brightness sensor
52 brightness comparator
54 brightness reference
56 light source
58 power source

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 11 illustrate an illuminated outlet of the present invention indicated generally by the numeral 10.

Figure 11:
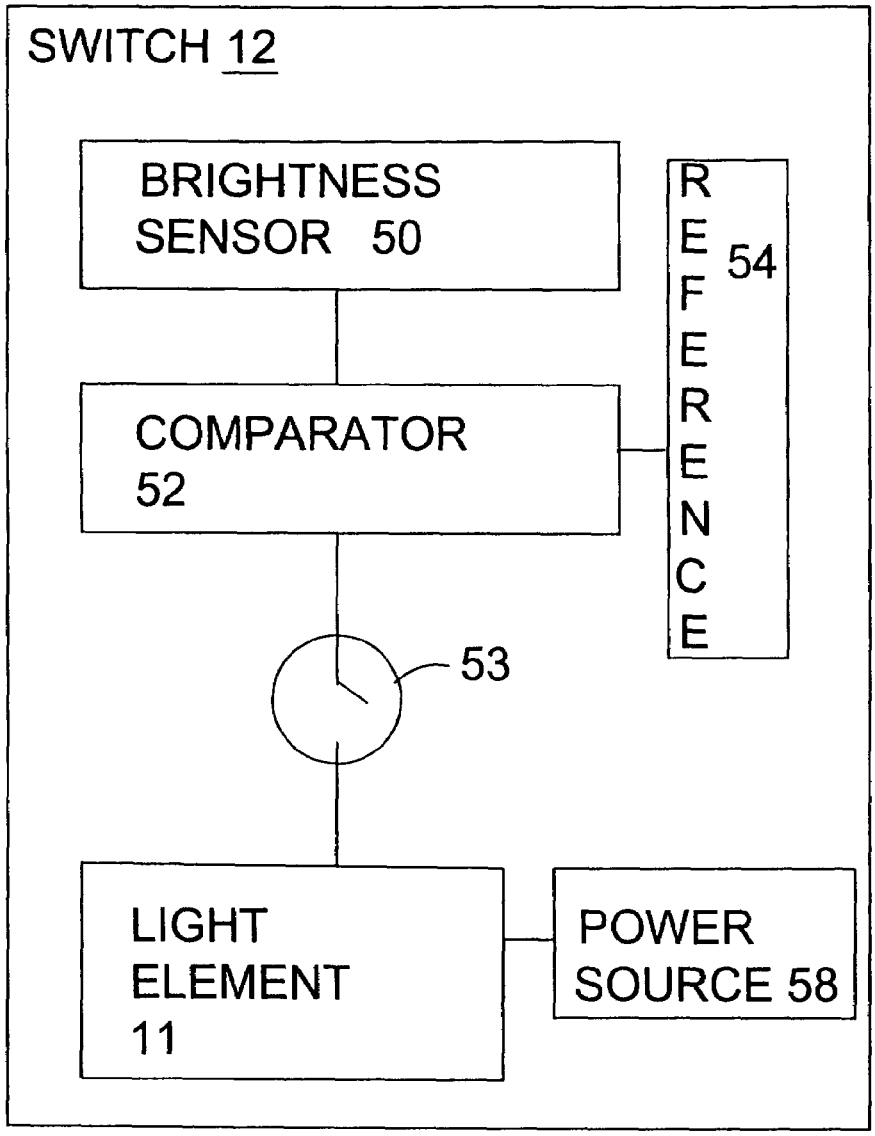
FIG. 11 is a block diagram of the illuminated outlets and switches of the present invention including a light sensor for detecting a level of light in a room.

FIG. 1 is an illustrative view of the illuminated outlets and switches 10 of the present invention in use. The present invention includes at least one of a light switch 12 and an electrical outlet 16, 18. The light switches 12 and outlets 16, 18 each include a lighting element 11 for illumination thereof. The light switch 12 is preferably positioned on a wall 4 of a room 2. The light switch 12 is secured by a light switch wall plate 14. Preferably, the light switch 12 is formed from material that is at least one of transparent and translucent. The lighting element 11 is positioned within the light switch 12 for illumination thereof. The lighting element 11 draws power from a power source located therein. The illuminated light switch 10 aides a user in locating the position of the switch 12 on the wall 4 when the room in which the light switch is positioned is not illuminated. The light switch 12 may include a sensor as shown in FIG. 11 therein for sensing a level of light present in the room 4. If the light level is determined to be below a reference level, the light switch 12 may then be selectively illuminated by the lighting element 11 contained therein. Illumination of the light switch using a brightness sensor will be discussed hereinafter with specific reference to FIG. 11.

The outlet 16, 18 of the present invention may include a light sensor similar to the one discussed with respect to the light switch 12. The outlet 16, 18 includes a face plate 15 formed from material that is at least one of transparent and translucent. The lighting element is positioned under the face plate 15 of the outlet 16, 18 and is contained within a receptacle. The lighting element may selectively emit light which aides a user in locating the outlet 16, 18 on the wall 4. This is especially useful when the outlet is located behind a piece of furniture. The lighting element emits light and directs the user to the location of the outlet. Additionally, as will be discussed with respect to FIGS. 8–10, the outlet 16, 18 is able to detect the capacity of the load and determine whether or not the capacity of the circuit is being exceeded prior to a circuit breaker cutting off a supply to the outlet. The plurality of lighting elements are each able to emit a color of light different than the other whereby a first color is illuminated when the circuit is below capacity and the second color is illuminated when the circuit exceeds capacity.

Figure 2:
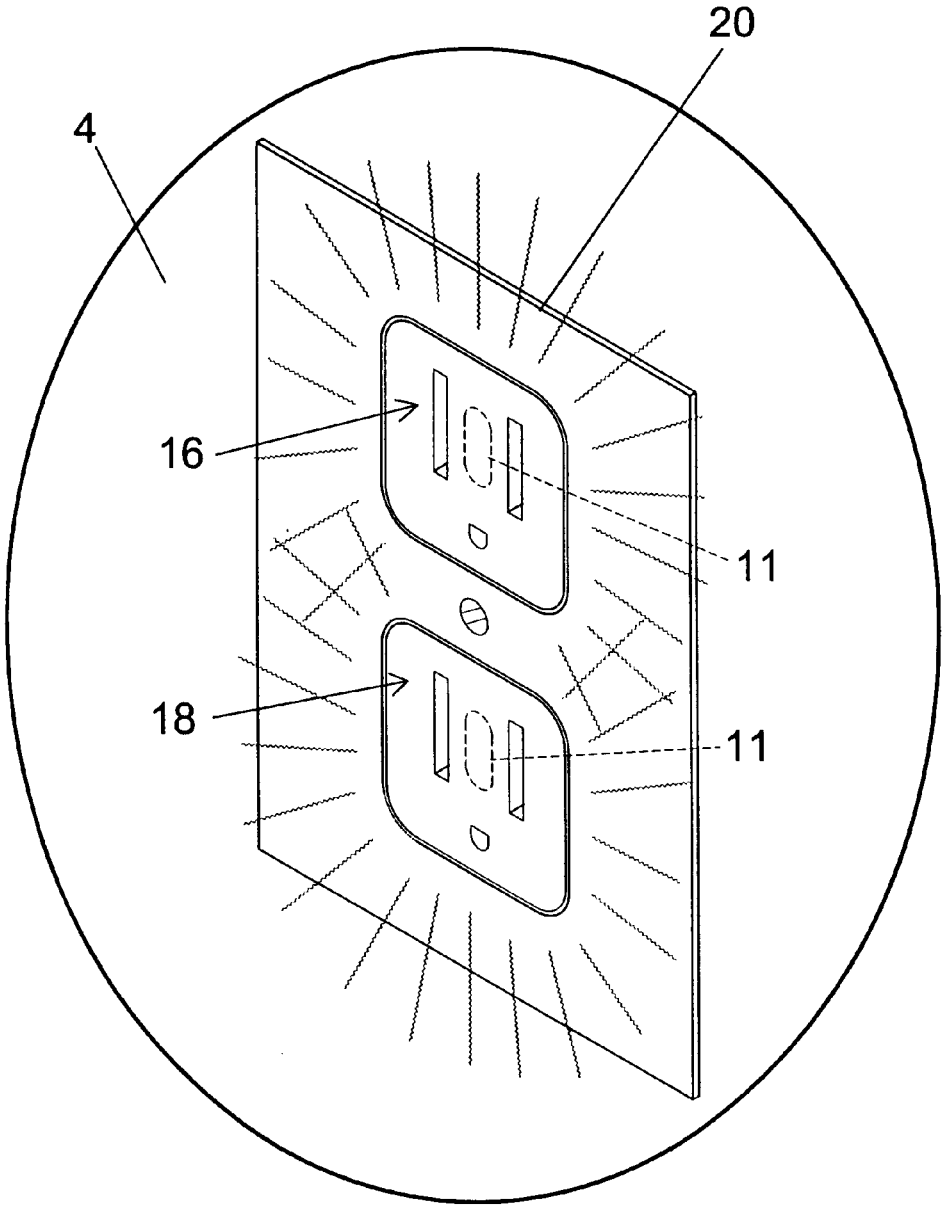
FIG. 2 is a perspective view of the illuminated receptacle of the illuminated outlet of the present invention.

FIG. 2 is a perspective view of the illuminated receptacle of the illuminated outlet of the present invention. The illuminated outlets 10 of the present invention include a first outlet 16 and a second outlet 18. The first and second outlets, 16 and 18 respectively, are positioned within the wall 4 and held in place by a outlet wall plate 20. The outlet wall plate 20 includes a first recess 22 extending therethrough. The first recess 22 is substantially the same shape and size as the first outlet 16. The outlet wall plate 20 also includes a second recess 24 extending therethrough. The second recess 24 is substantially the same shape and size as the second outlet 18. The outlets 16, 18 are preferably at least one of translucent and transparent thereby allowing light to be emitted therefrom. The first and second outlets 16, 18 each include the lighting element 11 contained within the receptacle 13 thereof. The receptacle 13 is clearly shown in FIG. 3. The lighting element 11 is selectively illuminated when a level of light in the room is below a predetermined reference level thereby causing light to be emitted from the lighting element, through the face plate 15 of each of the first outlet 16 and the second outlet 18.

Figure 3:
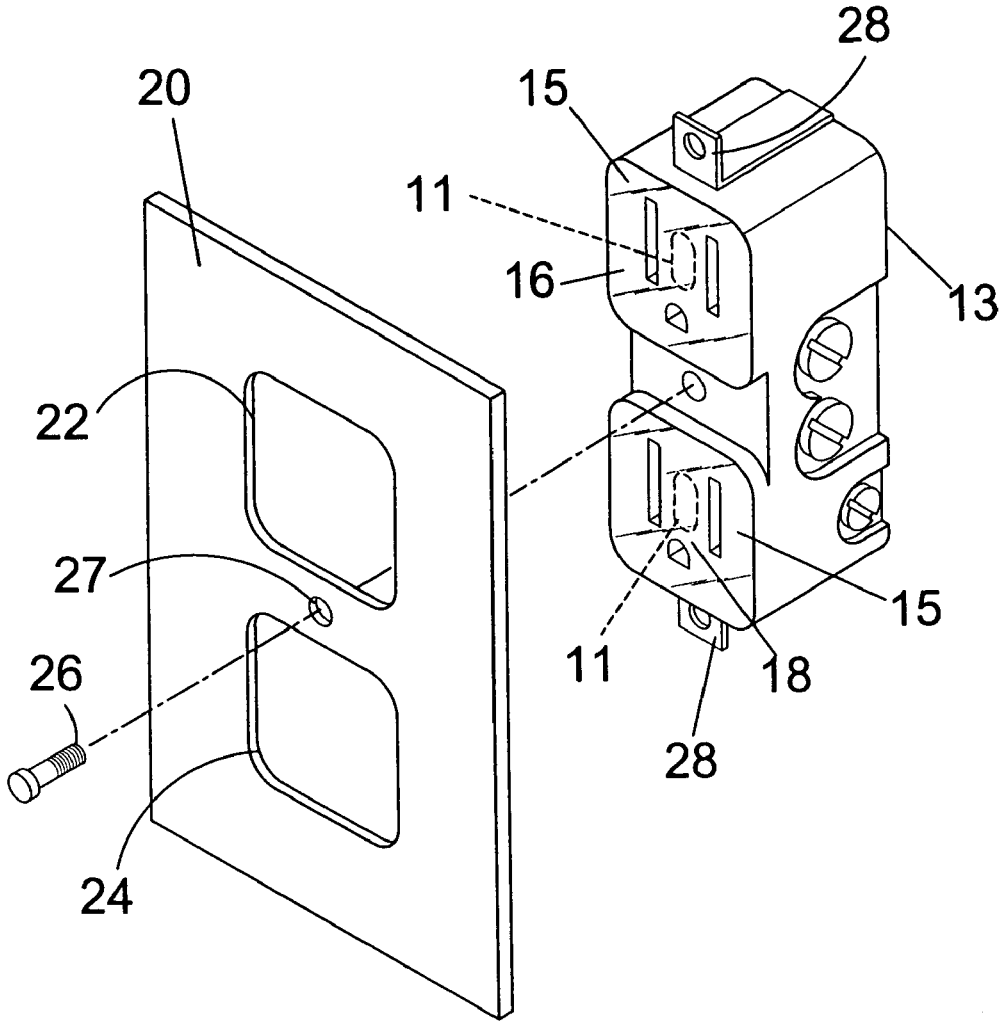
FIG. 3 is an exploded perspective view of the illuminated receptacle of the illuminated outlet of the present invention.

FIG. 3 is an exploded perspective view of the illuminated receptacle of the illuminated outlet of the present invention. The illuminated outlets 10 of the present invention include the first outlet 16 and the second outlet 18. The first and second outlets, 16 and 18 respectively, are positioned within the wall 4 and held in place by the outlet wall plate 20. The outlet wall plate 20 includes the first recess 22 extending therethrough. The first recess 22 is substantially the same shape and size as the first outlet 16. The outlet wall plate 20 also includes the second recess 24 extending therethrough. The second recess 24 is substantially the same shape and size as the second outlet 18. The outlets 16, 18 are preferably at least one of translucent and transparent thereby allowing light to be emitted therefrom. The first and second outlets 16, 18 each include the lighting element 11 contained within the receptacle 13 thereof. The lighting element 11 is selectively illuminated when a level of light in the room is below a predetermined reference level thereby causing light to be emitted from the lighting element, through the face plate 15 of each of the first outlet 16 and the second outlet 18.

The receptacle 13 is connected within the wall of a structure via receptacle connectors 28 which hold the receptacle 13 in place within the wall 4. The wall plate 20 is then connected to the receptacle 13 by a connector 26. The connector 26 is preferably a screw which passes through a connector recess 27 in the wall plate 20. The lighting elements 11 of the illuminated outlets 10 of the present invention receive power from the input voltage that is received by the receptacle 13. Illumination of the lighting elements 11 will be discussed hereinafter with specific reference to FIGS. 9 and 10.

Figure 4:
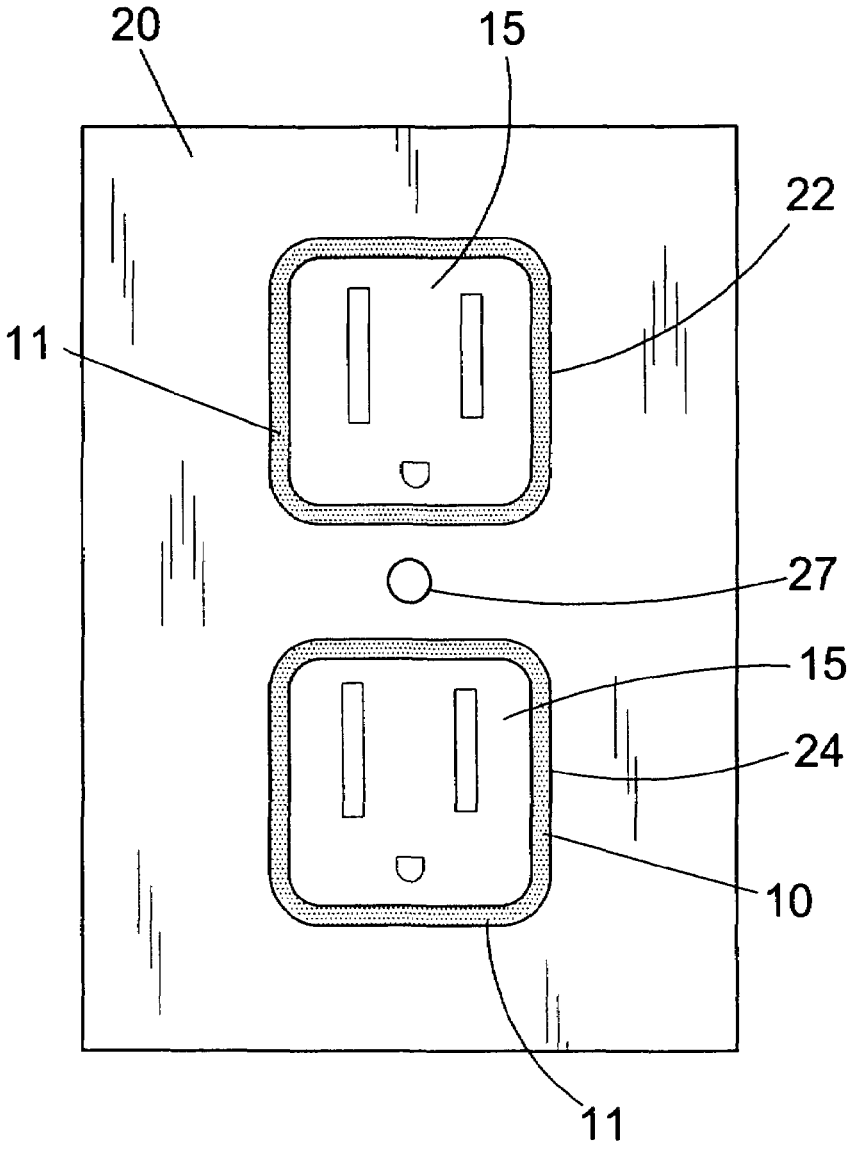
FIG. 4 is a front view of the outlet of the illuminated outlets and switches of the present invention not being illuminated.

FIG. 4 is a front view of the outlet of the illuminated outlets and switches of the present invention not being illuminated. The illuminated outlets 10 of the present invention include the first outlet 16 and the second outlet 18. The first and second outlets, 16 and 18 respectively, are positioned within the wall 4 and held in place by the outlet wall plate 20. The outlet wall plate 20 includes the first recess 22 extending therethrough. The first recess 22 is substantially the same shape and size as the first outlet 16. The outlet wall plate 20 also includes the second recess 24 extending therethrough. The second recess 24 is substantially the same shape and size as the second outlet 18. The outlets 16, 18 are preferably at least one of translucent and transparent thereby allowing light to be emitted therefrom. The first and second outlets 16, 18 each include the lighting element 11 contained within the receptacle 13 thereof. The lighting element 11 is selectively illuminated when a level of light in the room is below a predetermined reference level thereby causing light to be emitted from the lighting element, through the face plate 15 of each of the first outlet 16 and the second outlet 18.

Shown in FIG. 4 is an alternative placement of the lighting element 11. The lighting element 11 extends around a peripheral edge of each of the first outlet 16 and the second outlet 18. In this configuration, the lighting element can be contained within the receptacle 13 and thus emit light through the face plate 15 of the outlets 16, 18. Alternatively, the lighting element 11 maybe external from the receptacle 13 and positioned between the outlet 16, 18 and an edge of the recess 22, 24 of the wall plate 22. The lighting element 11 is selectively illuminable when the level of light in the room is below a predetermined reference level.

Figure 5:
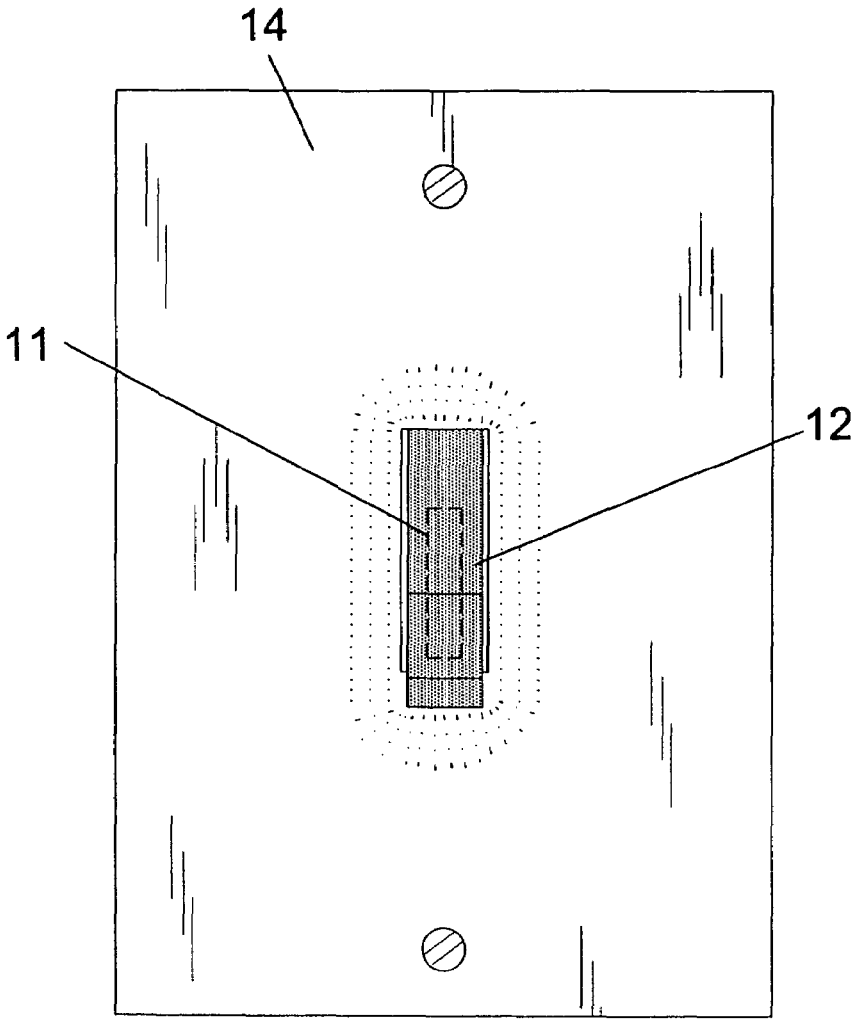
FIG. 5 is a front view of the light switch of the illuminated outlets and switches of the present invention being illuminated by a light source contained therein.

FIG. 5 is a front view of the light switch of the illuminated outlets and switches of the present invention being illuminated by a light source contained therein. The light switch 12 is secured in place by a light switch wall plate 14. Preferably, the light switch 12 is formed from material that is at least one of transparent and translucent. The lighting element 11 is positioned within the light switch 12 for illumination thereof. The lighting element 11 draws power from a power, source located therein. The illuminated light switch 10 of the present invention aides a user in locating the position of the switch 12 on the wall 4. The light switch 12 may include a sensor as shown in FIG. 11 therein for sensing a level of light present in the room 4. If the light level is determined to be below a reference level, the light switch 12 may then be selectively illuminated by the lighting element 11 contained therein. Illumination of the light switch using a brightness sensor will be discussed hereinafter with specific reference to FIG. 11.

Figure 6:
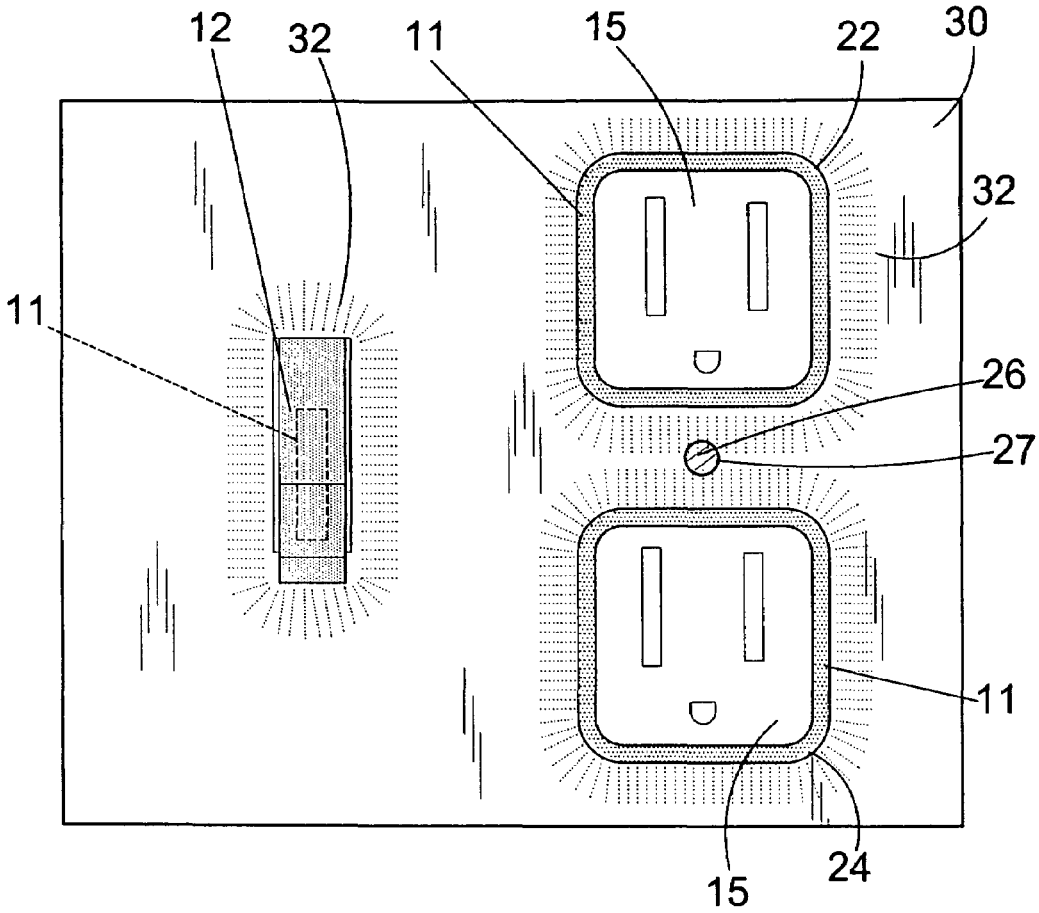
FIG. 6 is a front view of the illuminated outlets and switches of the present invention having a combined outlet and switch.

FIG. 6 is a front view of the illuminated outlets and switches of the present invention having both outlets and switches. The light switch 12 is secured in place by a light switch wall plate 14. Preferably, the light switch 12 is formed from material that is at least one of transparent and translucent. The lighting element 11 is positioned within the light switch 12 for illumination thereof. The lighting element 11 draws power from a power source located therein. The illuminated light switch 10 of the present invention aides a user in locating the position of the switch 12 on the wall 4. The light switch 12 may include a sensor as shown in FIG. 11 therein for sensing a level of light present in the room 4. If the light level is determined to be below a reference level, the light switch 12 may then be selectively illuminated by the lighting element 11 contained therein.

The illuminated outlets 10 of the present invention include the first outlet 16 and the second outlet 18. The first and second outlets, 16 and 18 respectively, are positioned within the wall 4 and held in place by the outlet wall plate 20. The outlet wall plate 20 includes the first recess 22 extending therethrough. The first recess 22 is substantially the same shape and size as the first outlet 16. The outlet wall plate 20 also includes the second recess 24 extending therethrough. The second recess 24 is substantially the same shape and size as the second outlet 18. The outlets 16, 18 are preferably at least one of translucent and transparent thereby allowing light to be emitted therefrom. The first and second outlets 16, 18 each include the lighting element 11 contained within the receptacle 13 thereof. The lighting element 11 is selectively illuminated when a level of light in the room is below a predetermined reference level thereby causing light to be emitted from the lighting element, through the face plate 15 of each of the first outlet 16 and the second outlet 18. The lighting element 11 extends around a peripheral edge of each of the first outlet 16 and the second outlet 18. In this configuration, the lighting element can be contained within the receptacle 13 and thus emit light through the face plate 15 of the outlets 16, 18. Alternatively, the lighting element 11 maybe external from the receptacle 13 and positioned between the outlet 16, 18 and an edge of the recess 22, 24 of the wall plate 22. The lighting element 11 is selectively illuminable when the level of light in the room is below a predetermined reference level.

A combination switch/outlet wall plate 30 is shown in FIG. 6. The combination wall plate 30 includes both the light switch 12 and the first and second outlets 16 and 18 respectively. The combination wall plate 30 includes the connection recess for selectively securing the light switch 12 and outlets 16, 18 within the wall with the connector 26. The connector 26 passes through the recess 27 and secures the combination wall plate 30 to the wall. The light switch 12 and the outlets 16, 18 are shown in FIG. 6 being illuminated by the lighting elements 11. The light being emitted from the lighting elements 11 is labeled with the reference numeral 32. The light 32 being emitted therefrom aides the user in locating at least one of the light switch 12 and the first and second outlets 16 and 18 respectively.

Figure 7:
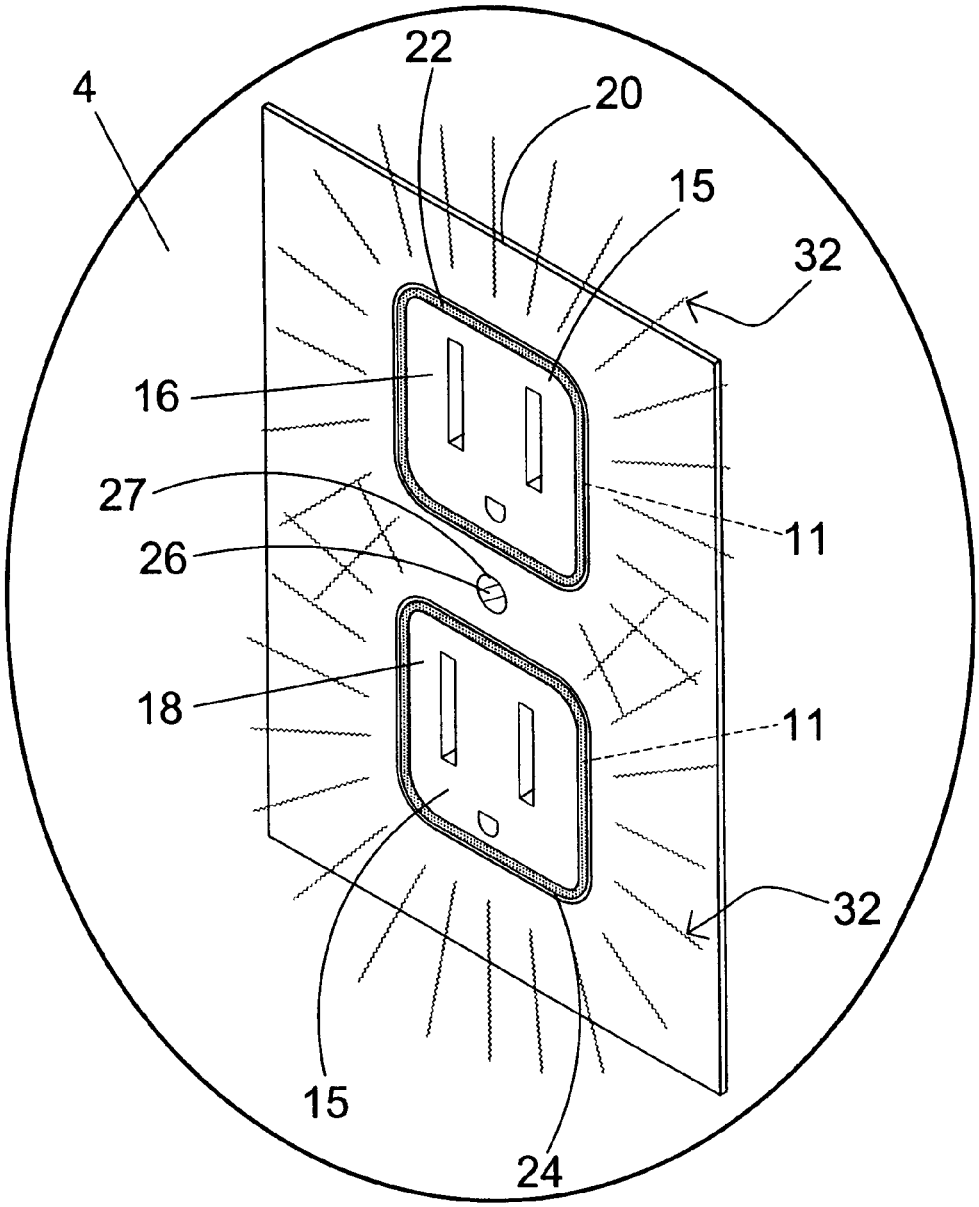
FIG. 7 is a perspective view of the illuminated outlet of the present invention.

FIG. 7 is a perspective view of the illuminated outlet of the present invention. The illuminated outlets 10 of the present invention include the first outlet 16 and the second outlet 18. The first and second outlets, 16 and 18 respectively, are positioned within the wall 4 and held in place by the outlet wall plate 20. The outlet wall plate 20 includes the first recess 22 extending therethrough. The first recess 22 is substantially the same shape and size as the first outlet 16. The outlet wall plate 20 also includes the second recess 24 extending therethrough. The second recess 24 is substantially the same shape and size as the second outlet 18. The outlets 16, 18 are preferably at least one of translucent and transparent thereby allowing light to be emitted therefrom. The first and second outlets 16, 18 each include the lighting element 11 contained within the receptacle 13 thereof. The lighting element 11 is selectively illuminated when a level of light in the room is below a predetermined reference level thereby causing light to be emitted from the lighting element, through the face plate 15 of each of the first outlet 16 and the second outlet 18. The lighting element 11 extends around a peripheral edge of each of the first outlet 16 and the second outlet 18. In this configuration, the lighting element can be contained within the receptacle 13 and thus emit light through the face plate 15 of the outlets 16, 18. Alternatively, the lighting element 11 maybe external from the receptacle 13 and positioned between the outlet 16, 18 and an edge of the recess 22, 24 of the wall plate 22. The lighting element 11 is selectively illuminable when the level of light in the room is below a predetermined reference level.

As shown in FIG. 7, the level of light present in the room is below the predetermined reference level and thus the lighting elements 11 are emitting light therefrom as is indicated by the lines identified by the numeral 32. By emitting light 32 therefrom, the user is able to more easily locate the first and second outlets 16 and 18 respectively. Upon the level of light rising above the predetermined reference level, the lighting element 11 no longer need to emit light therefrom as the room is illuminated to a degree whereby the sockets and switches may be seen without aid.

Figure 8:
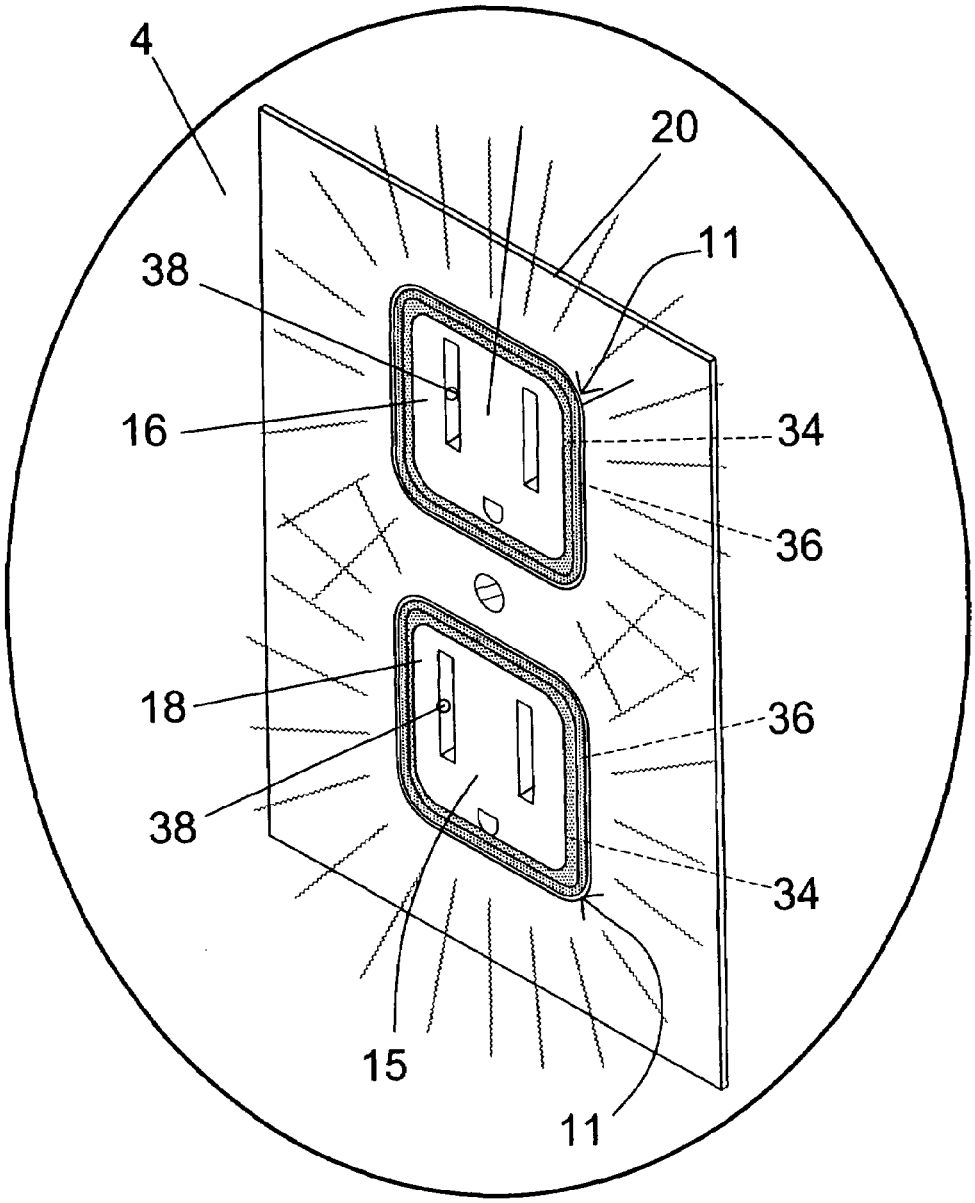
FIG. 8 is a perspective view of the illuminated outlet of the present invention having two different colored light sources contained therein.

FIG. 8 is a perspective view of the illuminated outlet of the present invention having two different colored light sources contained therein. The illuminated outlets 10 of the present invention include the first outlet 16 and the second outlet 18. The first and second outlets, 16 and 18 respectively, are positioned within the wall 4 and held in place by the outlet wall plate 20. The outlet wall plate 20 includes the first recess 22 extending therethrough. The first recess 22 is substantially the same shape and size as the first outlet 16. The outlet wall plate 20 also includes the second recess 24 extending therethrough. The second recess 24 is substantially the same shape and size as the second outlet 18. The outlets 16, 18 are preferably at least one of translucent and transparent thereby allowing light to be emitted therefrom. The first and second outlets 16, 18 each include the lighting element 11 contained within the receptacle 13 thereof. The lighting element 11 is selectively illuminated when a level of light in the room is below a predetermined reference level thereby causing light to be emitted from the lighting element, through the face plate 15 of each of the first outlet 16 and the second outlet 18. The lighting element 11 extends around a peripheral edge of each of the first outlet 16 and the second outlet 18.

In FIG. 8, a the first outlet 16 and the second outlet 18 include at least two lighting elements, each respective one of the lighting elements emits a different colored light. A first colored lighting element 34 is positioned around a periphery of the first and second outlets 16 and 18 respectively. A second colored lighting element 36 is positioned around the periphery of the first colored lighting element 34 on a side thereof opposite from the outlets 16, 18. Alternatively, the first colored lighting element 34 and the second colored lighting element 36 may be contained within the receptacle 13 thereby emitting light through the face plate 15 of the outlets 16, 18.

This embodiment further includes a sensor switch 38 positioned within the outlet 16, 18. The sensor switch 38 senses the amount of load placed on the circuit and determines, as will discussed hereinafter with specific reference to FIGS. 9 and 10, whether or not the capacity of the circuit has been exceeded by the addition of the load. If the capacity of the circuit is below a predetermined reference level indicating the power being used by the apparatus connected to the socket is within a level which is able to be adequately supplied then the first colored lighting element 34 is illuminated signifying that the outlet is safe to use. If the capacity of the circuit is above the predetermined reference value, indicating a circuit breaker will cut off power to the socket should the drain of power increase, then the second colored lighting element 36 is illuminated. The second colored lighting element 36 emits a color of light that is different from the color of light emitted by the first lighting element 34.

Figure 9:
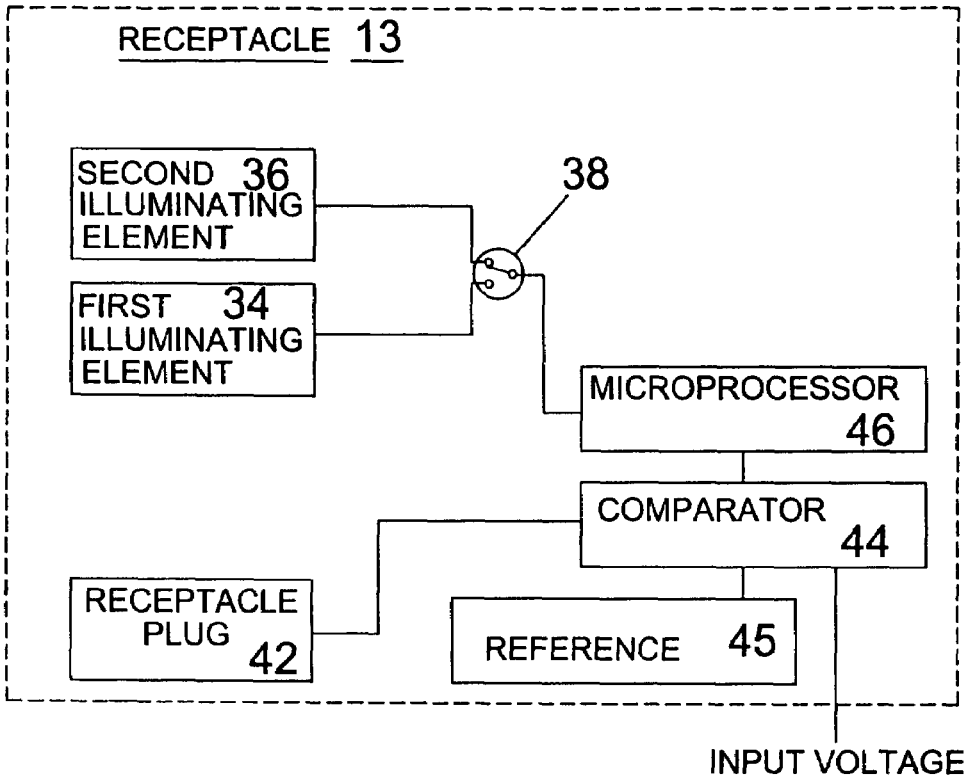
FIG. 9 is a block diagram of the illuminated outlet of the present invention for detecting the capacity of a circuit therein.

FIG. 9 is a block diagram of the illuminated outlet of the present invention for detecting if a plug is inserted in the socket. The receptacle 13 includes the first colored lighting element 34 and the second colored lighting element 36. The receptacle 13 further includes a microprocessor 46 for controlling the sensor switch 38 which is positioned between the colored lighting elements 34 and 36 respectively, and the microprocessor 46. A comparator is connected between a receptacle plug 42 and an input voltage 44 for comparing a load value on the socket to a reference value 45. The comparator 44 is also connected to the microprocessor 46 for directing the microprocessor to toggle the sensor switch 38 between the first colored lighting element 34 and the second colored lighting element 36 based upon the results of the comparison.

The method of detecting whether a plug is inserted in the socket will now be discussed with specific reference to FIG. 9. Upon the receptacle plug 42 being received within the receptacle 13, the comparator 44 compares the input voltage or load on the socket to the reference voltage. If the voltage value from the receptacle plug 42 is below the reference voltage value, then the comparator 44 directs the microprocessor to toggle the lead of the sensor switch 38 to contact the first colored lighting element 34 indicating a plug is not inserted in the socket. If the voltage value from the receptacle plug 42 is greater than the value of the reference voltage 45, the comparator 44 directs the microprocessor to toggle the lead of the sensor switch 38 to contact the second colored lighting element 36 indicating a plug is inserted in the socket. Preferably, the first colored lighting element is green and the second colored lighting element is red. However, the first and second lighting elements can emit light having any color so long as the colors are different from one another.

Figure 10:
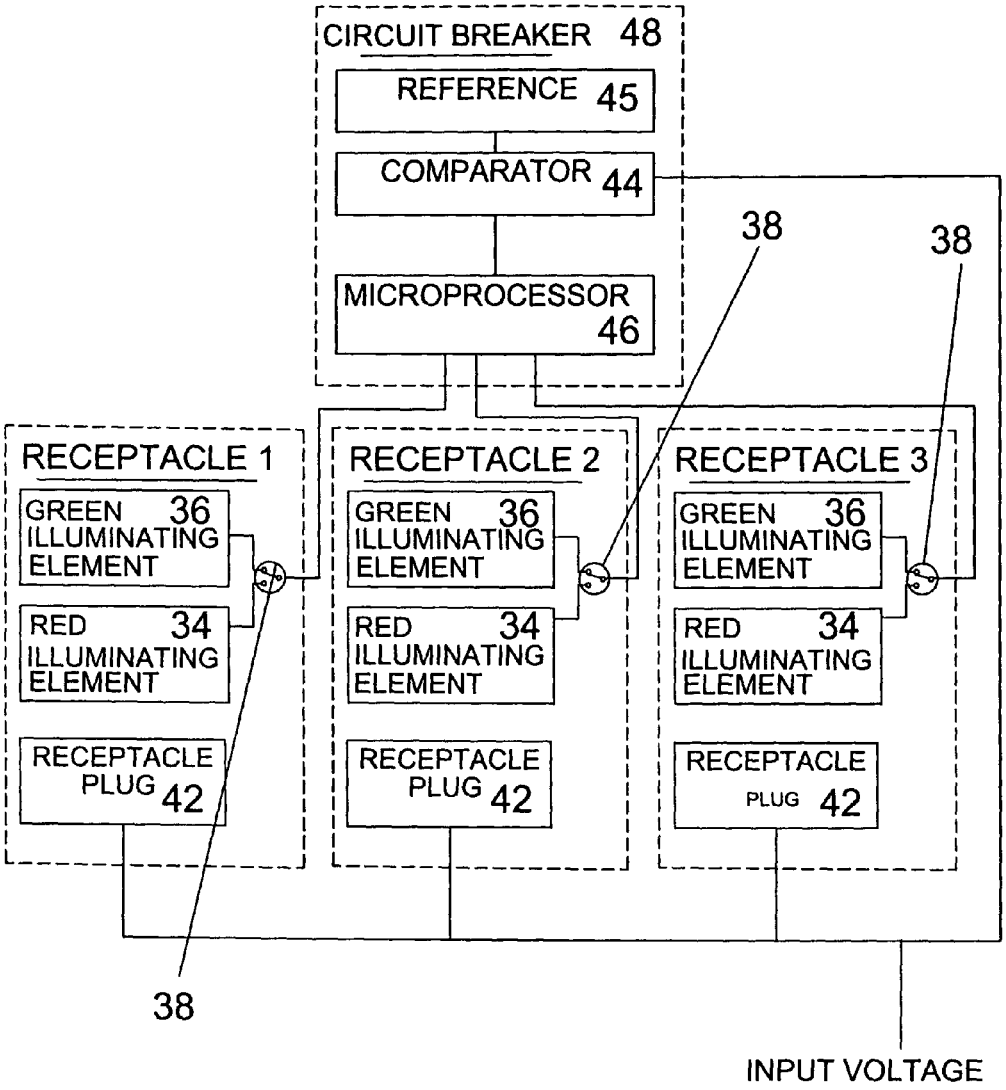
FIG. 10 is a block diagram of the a plurality of illuminated outlets of the present invention including a circuit breaker for detecting the capacity of a circuit therein.

FIG. 10 is a block diagram of the plurality of illuminated outlets of the present invention including a circuit breaker for detecting the capacity of a circuit therein. This embodiment includes a circuit breaker 48 having the comparator 44 coupled to receive the reference value 45 and an input voltage value. The output of the comparator is connected to the microprocessor 46 contained within the circuit breaker 48. A plurality of receptacles 13 are connected to receive the input voltage. Each receptacle includes the first colored lighting element 34 and the second colored lighting element 36. The sensor switch 38 is connected between the lighting elements 34, 36 and the microprocessor 46 of the circuit breaker 48. The comparator 44 receives the input voltage value and compares the value with the predetermined reference value 45. Upon determining that the input value is below the reference value, the comparator 44 directs the microprocessor 46 to toggle the sensor switch 38 to contact a lead extending from the first colored lighting element 34 for emitting a colored light therefrom and indicating the input voltage is adequate to supply the load on the receptacles. If the comparator 44 determines that input value is above the reference value, the comparator 44 directs the microprocessor 46 to toggle the sensor switch 38 to contact the lead extending from the second colored lighting element for emitting a colored light therefrom and indicating the input voltage is not adequate to supply the load on the receptacles and a circuit breaker will be activated to cut off the supply to the receptacles. The colored light emitted from the first colored lighting 34 element has a color different than the colored light emitted from the second colored lighting element 36.

FIG. 11 is a block diagram of the illuminated outlets and switches of the present invention including a light sensor for detecting a level of light in a room. The switch 12 includes a brightness sensor 50 for sensing the level of light in a room. The brightness sensor 50 is connected to a brightness comparator 52. The brightness comparator 52 compares a brightness value received from the brightness sensor with a brightness reference value 54. If the brightness value is below the reference value indicating the room is not illuminated, the comparator 52 directs a switch 53 to move from a first open position to a second closed position thereby closing an electrical circuit. Upon closing the electrical circuit, the lighting element 11 receives power from a power source 58 thereby causing the lighting element to be illuminated. If the brightness value is greater than the reference value, the comparator 52 directs the switch 53 to move from the second closed position to the first open position indicating the room is illuminated, thereby disrupting the electrical circuit.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various application without omitting features that, from the standpoint of prior art, fairly constitute essential characteristics of the generic of specific aspects of this invention.

What is claimed as new and desired to be protected by Letters Patent is set forth in the appended claims:

1. An electrical outlet comprising:

a) an electrical receptacle having a face plate, said receptacle being transparent or translucent;

b) a lighting element wholly embedded within said receptacle so that light from said lighting element when energized is visible through a front face of said receptacle to outside of said receptacle;

c) means for detecting a level of illumination surrounding said electrical outlet; and d) means for illuminating said lighting element upon determining the detected level of illumination is below a predetermined value thereby aiding in locating said electrical outlet in a room illuminated below a predetermined level.

2. The electrical outlet as recited in claim 1, wherein said means for illuminating said lighting element is a light sensor.

3. The electrical outlet as recited in claim 2, wherein said light element is embedded behind said front face of said receptacle between electrical sockets in said front face.

4. The electrical outlet as recited in claim 2, wherein said light element is embedded in said front face of said receptacle along a perimeter of said receptacle face.

5. An electrical outlet comprising:

a) a receptacle having a face plate, said receptacle being transparent or translucent;

b) a first lighting element producing a first color when energized embedded within said receptacle so that light from said first lighting element when energized is visible through a front face of said receptacle to outside of said receptacle, said first lighting element extending along a periphery of a front face of said receptacle;

c) a second lighting element producing a second color different from said first color when energized embedded within said receptacle so that light from said second lighting element when energized is visible through a front face of said receptacle to outside of said receptacle, said second lighting element extending along the periphery of said front face of said receptacle adjacent said first lighting element;

d) a sensor for sensing electrical load in a circuit in which said receptacle is located;

g) means for comparing a sensed load value with a threshold value; and h) a microprocessor connected to said load comparing means, wherein, upon said load comparing means detecting said load value is less than said threshold value, said microprocessor directs a switch to contact a first lead extending from said first lighting element for illumination thereof and, upon said load comparing means detecting said load value is greater than said threshold value, said microprocessor directs said switch to contact a second lead extending from said second lighting element for illumination thereof thereby indicating by color when said threshold value is exceeded.

* * * * *